US010942477B1

(12) United States Patent
Ono

(10) Patent No.: US 10,942,477 B1
(45) Date of Patent: Mar. 9, 2021

(54) CONVERSION OF IMAGE DATA IN ACCORDANCE WITH A POSITION OF A HEAT ELEMENT ABOVE A PREDETERMINED TEMPERATURE IN IMAGE FORMING APPARATUS AND IMAGE FORMING METHOD

(71) Applicant: TOSHIBA TEC KABUSHIKI KAISHA, Tokyo (JP)

(72) Inventor: Shinji Ono, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/793,704

(22) Filed: Feb. 18, 2020

(51) Int. Cl.
*G03G 15/20* (2006.01)

(52) U.S. Cl.
CPC ..... *G03G 15/205* (2013.01); *G03G 15/2053* (2013.01); *G03G 2215/00329* (2013.01); *G03G 2215/00413* (2013.01); *G03G 2215/00632* (2013.01)

(58) Field of Classification Search
CPC ..... G03G 15/04018; G03G 15/6588; G03G 15/6594; G03G 15/2039; G03G 15/2042; G03G 15/205; G03G 2215/00413; G03G 2215/00472; G03G 2215/00734
USPC ..... 399/182, 45, 69, 70
See application file for complete search history.

(56) References Cited

U.S. PATENT DOCUMENTS

| | | | | |
|---|---|---|---|---|
| 6,643,475 | B2 | 11/2003 | Hoberock et al. | |
| 6,842,592 | B2 * | 1/2005 | Kinoshita | G03G 15/6508 399/43 |
| 7,035,578 | B1 * | 4/2006 | Young | G03G 15/2025 399/322 |
| 10,108,119 | B1 * | 10/2018 | Yahata | G03G 15/2053 |

* cited by examiner

*Primary Examiner* — Arlene Heredia
(74) *Attorney, Agent, or Firm* — Kim & Stewart LLP

(57) ABSTRACT

An image forming apparatus includes a fixing unit, an image forming unit, and a controller. The controller is configured to receive image data corresponding to a target image to be formed on a sheet, convert the received image data to modified image data corresponding to a modified image that includes the target image and an added margin on at least one side of the target image in a sheet width direction side, control the image forming unit to form the modified image based on the modified image data, and cause the sheet to be conveyed to the image forming unit such that a positioning of the sheet in the sheet width direction overlaps with the target so that a fixing portion of the fixing unit overlaps with the target image in the modified image formed on the sheet.

19 Claims, 14 Drawing Sheets

CONVERSION OF IMAGE DATA IN ACCORDANCE WITH A POSITION OF A HEAT ELEMENT ABOVE A PREDETERMINED TEMPERATURE IN IMAGE FORMING APPARATUS AND IMAGE FORMING METHOD

FIELD

Embodiments described herein relate generally to an image forming apparatus and an image forming method.

BACKGROUND

An image forming apparatus including an on-demand heating device, such as a film fixing device, is known. For example, sheets of paper of the same size may continuously pass through such an on-demand heating device during image forming operations. In such a case, the temperature of a heater in the on-demand heating device may increase excessively in those portions/regions through which paper is not passing during the image forming operations, and thus there is a problem in that deterioration, breakdown, or burn out, or the like of a component of the on-demand heating device may occur.

DETAILED DESCRIPTION

Embodiments provide an image forming apparatus and an image forming method directed to suppressing unwanted temperature increases in a heater.

In general, according to an embodiment, an image forming apparatus includes a fixing unit, an image forming unit, and a controller. The image forming unit is configured to form an image on a sheet (for example, with toner). The fixing unit extends in a sheet width direction and is configured to fix images on sheets from the image forming unit. The controller is configured to receive image data corresponding to a target image to be formed on the sheet and convert the received image data to modified image data corresponding to a modified image that includes the target image and a margin added on at least one side of the target image in the sheet width direction. The controller controls the image forming unit to form the modified image based on a sheet, and cause the sheet to be conveyed to the image forming unit such that a positioning of the sheet in the sheet width direction that overlaps with the target image included in the modified image and a fixing portion (for example, a heated portion) of the fixing unit overlaps with the target image in the modified image formed on the sheet.

Hereinafter, an image forming apparatus and an image forming method according to certain example embodiments will be described with reference to the drawings.

Figure 1:
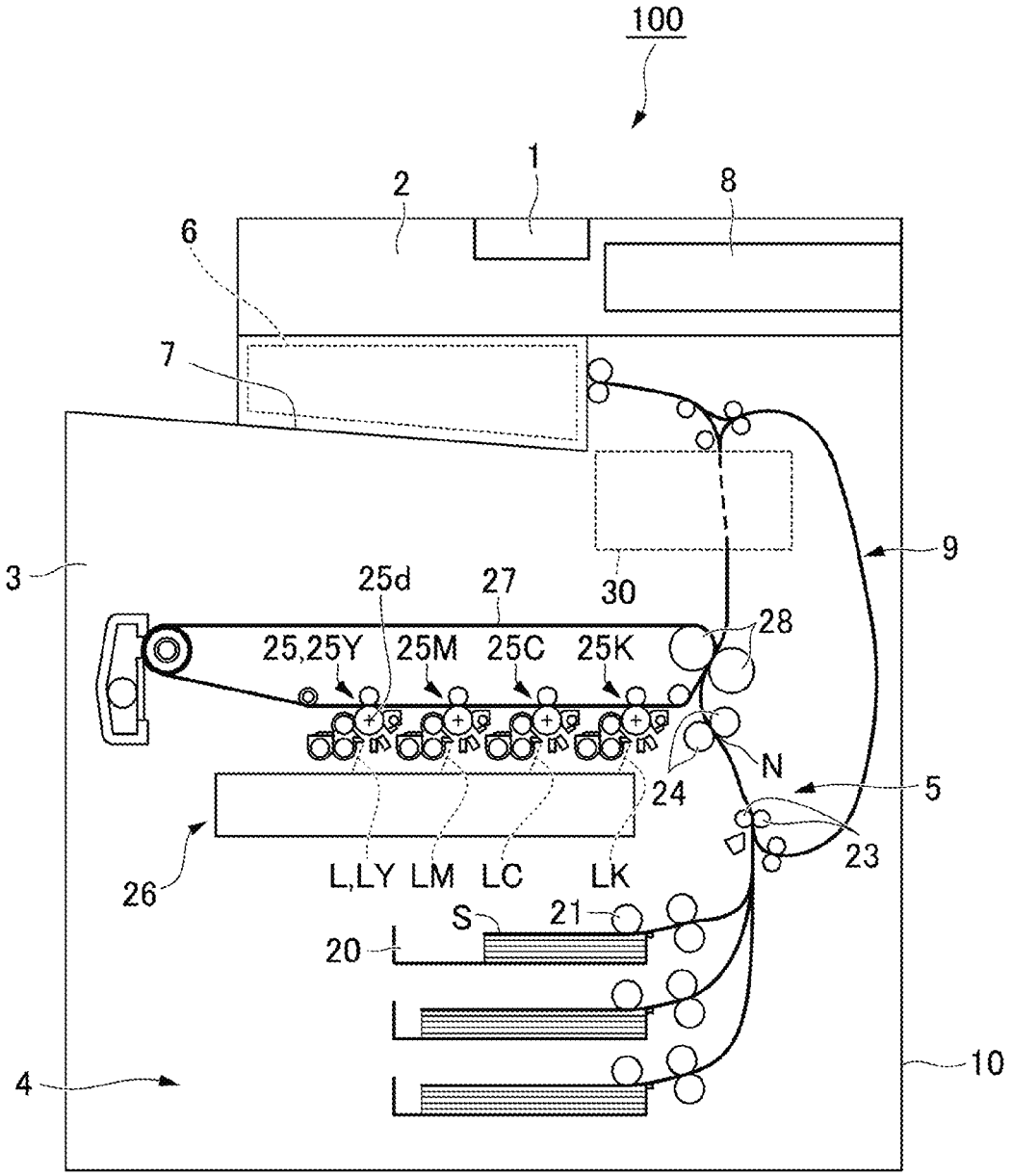
FIG. 1 is a diagram illustrating a schematic configuration of an image forming apparatus according to an embodiment.

FIG. 1 is a diagram illustrating a schematic configuration of an image forming apparatus according to an embodiment. An image forming apparatus 100 according to the embodiment is, for example, a multi-function peripheral.

The image forming apparatus 100 includes a housing 10, a display 1, a scanner unit 2, an image forming unit 3, a sheet supply unit 4, a conveying unit 5, a paper discharge tray 7, an inversion unit 9, a control panel 8, and a controller 6. The image forming unit 3 may be a device that fixes a toner image or an ink jet device.

The image forming apparatus 100 forms an image on a sheet S using a developer such as toner. The sheet S is, for example, paper or label paper. The sheet S may be any material as long as the image forming apparatus 100 can form an image on a surface of the sheet.

The housing 10 forms an external shape of the image forming apparatus 100.

The display 1 is an image display device such as a liquid crystal display or an organic EL (Electro Luminescence) display. The display 1 displays various information relating to the image forming apparatus 100.

The scanner unit 2 acquires image information from a reading target based on brightness and darkness of reflected light from the reading target and generates image data accordingly. The scanner unit 2 records the generated image data. The scanner unit 2 outputs the generated image data to the image forming unit 3. The recorded image data may be transmitted to another information processing apparatus through a network.

The image forming unit 3 forms an output image (hereinafter, referred to as "toner image") using a recording agent such as toner based on the image data received from the scanner unit 2 or image data received from an external apparatus. The image forming unit 3 transfers the toner image to a surface of the sheet S. The sheet S may be a sheet supplied by the sheet supply unit 4 or a sheet that is manually fed. The image forming unit 3 applies heat and pressure to the toner image on the surface of the sheet S such that the toner image is fixed to the sheet S.

The sheet supply unit 4 supplies sheets S to the conveying unit 5 one by one so the image forming unit 3 can form the toner image on the conveyed sheet S. The sheet supply unit 4 includes a sheet accommodation unit 20 and a pickup roller 21.

The sheet accommodation unit 20 accommodates a sheet S of a predetermined size and a predetermined type. The image forming apparatus 100 includes a plurality of sheet accommodation units 20. Each of the sheet accommodation units 20 may be referred to as a sheet storage. A sheet S is accommodated at different positions along a direction (an axial direction of a fixing belt 57 described below or a sheet width direction) perpendicular to a conveyance direction of the sheet S depending on the sheet accommodation units 20. Hereinafter, the conveyance direction of the sheet S will be referred to as "sheet conveyance direction", and the direction perpendicular to the conveyance direction of the sheet S in plane with the sheet S will be referred to as "sheet width direction".

The pickup roller 21 picks up each sheet S from the sheet accommodation unit 20 one by one. The pickup roller 21 supplies the just picked sheet S to the conveying unit 5.

The conveying unit 5 conveys the sheet S supplied from the sheet supply unit 4 to the image forming unit 3. The conveying unit 5 includes a conveying roller 23 and a registration roller 24.

The conveying roller 23 conveys the sheet S from the pickup roller 21 to the registration roller 24. The conveying roller 23 allows a tip (edge) of the sheet S in the sheet conveyance direction to abut against a nip N of the registration roller 24.

The registration roller 24 aligns a position of the tip of the sheet S in the sheet conveyance direction by bending the sheet S in the nip N. The registration roller 24 conveys the sheet S to image forming unit 3 at which time the image forming unit 3 transfers the toner image to the sheet S.

Hereinafter, the image forming unit 3 will be described.

The image forming unit 3 includes a plurality of image forming units 25 (25Y, 25M, 25C, and 25K), a laser scanning unit 26, an intermediate transfer belt 27, a transfer unit 28, and a fixing device 30.

Each image forming unit 25 includes a photoconductive drum 25*d*. Each image forming unit 25 forms the toner image on the photoconductive drum 25*d* based on the image data received from the scanner unit 2 or an external apparatus. The image forming units 25Y, 25M, 25C, and 25K form toner images using yellow, magenta, cyan, and black toners, respectively.

A charging unit, a developing unit, and the like are arranged around a periphery of the photoconductive drum 25*d*. The charging unit charges a surface of the photoconductive drum 25*d*. The developing unit stores a developer including the yellow, magenta, cyan, or black toners. The developing unit develops an electrostatic latent image on the photoconductive drum 25*d* with toner. As a result, the toner image is formed on a photoconductive drum 25*d* by each of the respective color toners.

The laser scanning unit 26 scans the charged photoconductive drums 25*d* with laser light L such that each photoconductive drum 25*d* is appropriately exposed. The same laser scanning unit 26 exposes the photoconductive drums 25*d* of each the image forming units 25Y, 25M, 25C, and 25K with the laser light components LY, LM, LC, and LK, respectively. As a result, the laser scanning unit 26 forms the electrostatic latent image on the photoconductive drums 25*d*.

The toner image on the surface of a photoconductive drum 25*d* is transferred (referred to as a primary transfer) to the intermediate transfer belt 27.

The transfer unit 28 then transfers (referred to as a secondary transfer) the toner image(s) from the intermediate transfer belt 27 to the surface of the sheet S at a secondary transfer position.

The fixing device 30 applies heat and pressure to the toner image on the sheet S such that the toner image is fixed to the sheet S.

The inversion unit 9 inverts, e.g., flips, the sheet S so an image can be formed on a back surface (other side) of the sheet S. The inversion unit 9 "switches back" the sheet S previously discharged from the fixing device 30 so as to invert the front and back surfaces of the sheet S. The inversion unit 9 then conveys the inverted sheet S to the registration roller 24.

A discharged sheet S on which the intended image has already been formed (e.g., printed) can be placed on the paper discharge tray 7.

The control panel 8 includes a plurality of buttons, for example. The control panel 8 receives an operation from a user. The control panel 8 then outputs a signal corresponding to the operation input by the user to the controller 6 of the image forming apparatus 100. The display 1 and the control panel 8 may be integrated as a touch panel or the like such that user inputs may be received as touch selections of items graphically displayed on display 1.

The controller 6 controls the respective units of the image forming apparatus 100.

Figure 2:
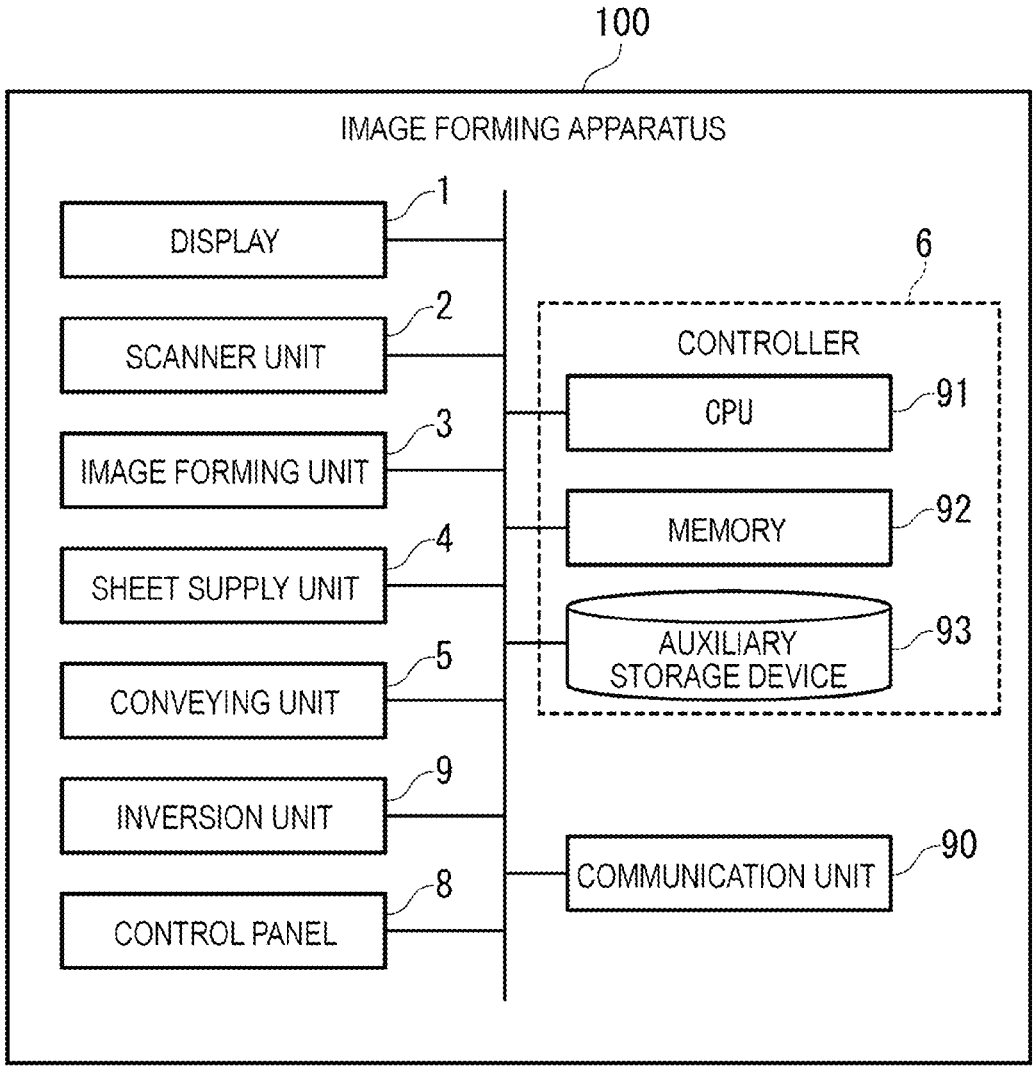
FIG. 2 is a diagram illustrating a hardware configuration of an image forming apparatus according to an embodiment.

FIG. 2 is a diagram illustrating a hardware configuration of the image forming apparatus 100 according to an embodiment. The image forming apparatus 100 includes a central processing unit (CPU) 91, a memory 92, and an auxiliary storage device 93 connected through a bus. In general, the CPU 91 executes a program. By executing the program, the image forming apparatus 100 is configured as an special-purpose device including a scanner unit 2, an image forming unit 3, a sheet supply unit 4, a conveying unit 5, an inversion unit 9, a control panel 8, and a communication unit 90.

The CPU 91 functions as the controller 6 by executing a program stored in the memory 92 and/or the auxiliary storage device 93. The controller 6 controls operations of the respective functional units of the image forming apparatus 100.

The auxiliary storage device 93 may comprise a storage device such as a magnetic hard disk device or a semiconductor memory device. The auxiliary storage device 93 stores various information relating to operations and controls of the image forming apparatus 100.

The communication unit 90 comprises a communication interface for connecting the image forming apparatus 100 to an external apparatus. The communication unit 90 communicates with the external apparatus through the communication interface.

Figure 3:
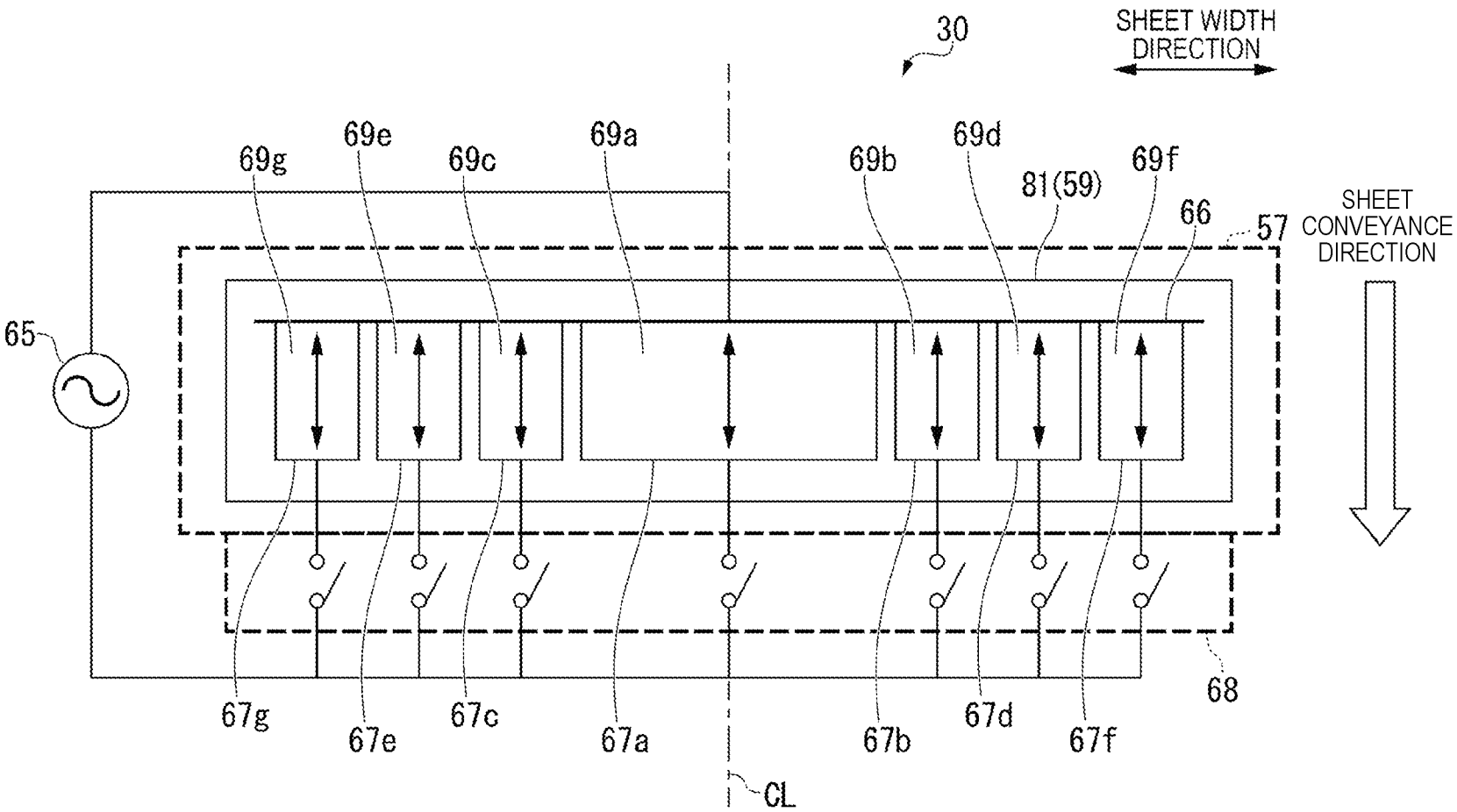
FIG. 3 is a schematic diagram illustrating a configuration example of a fixing device.
Figure 4:
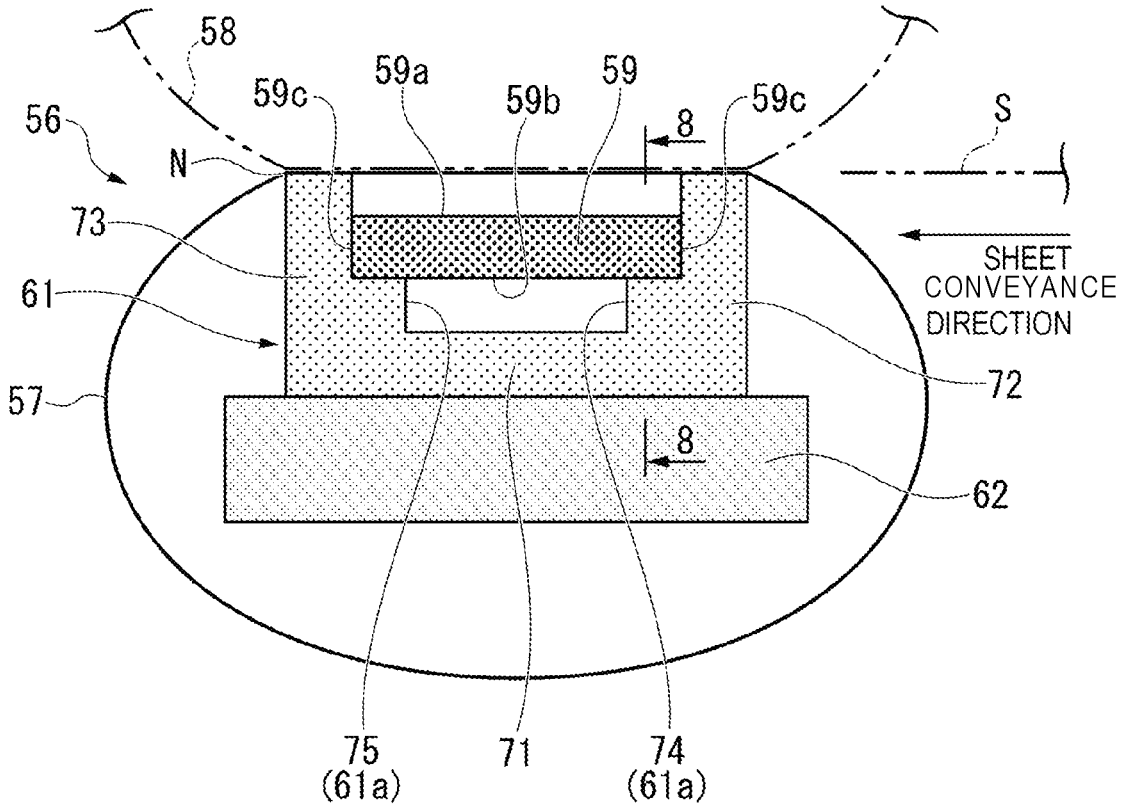
FIG. 4 is a cross-sectional diagram intersecting (perpendicular to) a longitudinal direction of a heater.

FIG. 3 is a schematic diagram illustrating a configuration example of the fixing device 30 according to an embodiment. FIG. 3 illustrates arrangement of heat generation resistor layers 69*a* to 69*g* and connections between the heat generation resistor layers 69*a* to 69*g* and drive circuits thereof. Each of the heat generation resistor layers 69*a* to 69*g* may be referred to as a heater element or a heat generation resistor. FIG. 4 is a cross-sectional diagram perpendicular to a longitudinal direction of a heater 59 in the fixing device 30 according to the embodiment. FIG. 4 illustrates a cross-section of a support region 61*c* described below.

The fixing device 30 according to the embodiment illustrated in FIGS. 3 and 4 includes a fixing belt 57, a pressing roller 58, and a heater 59.

The fixing belt 57 is a thin, flexible material formed into a cylindrical shape. The fixing belt 57 can be referred to as an endless belt-shaped member or a film-shaped member in some contexts. Although not specifically illustrated in FIG. 4, the fixing belt 57 in this example includes: a base material and a release layer on an outer circumferential surface of the base material. The base material is a metal material, such as nickel or stainless steel, or a resin material, such as polyimide (PI). For the release layer, for example, a tetrafluoroethylene-perfluoroalkyl vinyl ether copolymer (PFA) or polytetrafluoroethylene (PTFE) can be used. An elastic layer that is formed of a rubber material, such as silicone rubber, foaming silicone rubber, or fluoropolymer, may be interposed between the base material and the release layer.

Opposite end of the fixing belt 57 in the axial direction can be fit to a support member (not separately illustrated). The support member supports the axial ends of the fixing belt 57 during fixing operations. The support member helps hold the desired shape of the ends of the fixing belt 57 in the axial direction. On the other hand, an intermediate portion of the fixing belt 57 between the axial ends is likely to be deformed because the support member is not fitted thereto. The fixing belt 57 is rotatable around the axis of the fixing belt 57 when supported by the support member.

For example, the fixing belt 57 and the pressing roller 58 are arranged along a horizontal plane. The pressing roller 58 is pressed toward the fixing belt 57 by a pressing unit so as to come into contact with an outer circumferential surface of the fixing belt 57. At the portion where the pressing roller 58 and the fixing belt 57 are pressed against each other, a surface layer of the pressing roller 58 and the fixing belt 57 are compressed by each other and form a nip N. In the nip N, the sheet S passes between the pressing roller 58 and the fixing belt 57.

The pressing roller 58 is rotated by a drive source such as a motor provided in the housing 10. When the pressing roller 58 is rotated, the driving force of the pressing roller 58 is transmitted to the fixing belt 57 in the nip N such that the fixing belt 57 is rotated. Due to the rotation of the pressing roller 58 and the fixing belt 57, the sheet S inserted into the nip N is conveyed to the downstream side in the conveyance direction. At this time, the toner image transferred to the sheet S is fixed to the sheet S due to heat of the fixing belt 57.

The heater 59 is arranged on an inner peripheral side of the fixing belt 57 and extends toward the longitudinal direction (in parallel) in the sheet width direction. The heater 59 has a length exceeding the full width of the sheet S having a maximum width in which the sheet S can pass through the fixing device 30. The fixing belt 57 has a width exceeding the length of the heater 59. The fixing belt 57 is heated in a range facing the heater 59.

The heater 59 is formed in a band plate shape extending in the longitudinal direction, which may be along the axial direction of the fixing belt 57 and/or the sheet width direction. The heater 59 is arranged in a state where one surface (upper surface in FIG. 4) of front and back surfaces thereof faces an inner circumferential surface of the fixing belt 57. The heat output of the heater 59 is controlled by a power supply unit (provided in the housing 10 such that the fixing belt 57 is heated. The heater 59 is held by a holder 61 extending in the longitudinal direction of the heater 59.

The fixing device 30 according to the embodiment illustrated in FIGS. 3 and 4 heats the fixing belt 57 using a divided heater type. On a base (for example, a ceramic heater substrate) of the heater 59, a seven heat generation resistor layers 69*a* to 69*g* that are arranged along the sheet width direction are provided.

The fixing device 30 can align the sheet S in the sheet width direction such that a center portion of the sheet S in the width direction overlaps a center portion (indicated by CL in the drawing) of the heater 59 in the longitudinal direction. That is, the fixing device 30 can convey the sheet S in a state where the center portion of the sheet S in the width direction matches the center portion CL of the heater 59 in the longitudinal direction. Alternatively, the fixing device 30 can also align (side alignment) the sheet S in the sheet width direction based on one side in the sheet width direction. Alternatively, the fixing device 30 can also align the sheet S at any position in the sheet width direction.

For the heat generation resistor layers 69*a* to 69*g*, an input-side electrode 66 (also referred to as a common electrode in some contexts) and output-side electrodes 67*a* to 67*g* (also referred to as individual electrodes in some contexts) that apply an alternating current from an alternating current power supply 65 are provided. A switching element of a drive IC 68 is connected to each of the output-side electrodes 67*a* to 67*g*. Energization of each of the heat generation resistor layers 69*a* to 69*g* can be individually controlled by the drive IC 68. In this example, the input-side electrode is arranged upstream of the heater in the sheet conveyance direction. The output-side electrodes 67*a* to 67*g* are arranged downstream of the heater 59 in the sheet conveyance direction.

In FIG. 3, the common electrode (input-side electrode) 66 is arranged on the upstream side. However, the common electrode may instead be arranged on the downstream side. In FIG. 3, the temperatures of each of the respective heat generation resistor layers 69*a* to 69*g* can be individually controlled. However, in other examples, pairs of bilaterally symmetric heat generation resistor layers may share a switching element. In such a case, the temperatures of the paired bilaterally symmetric heat generation resistor layers could be controlled together. In other examples, other appropriate combination of heat generation resistor layers from among the heat generation resistor layers 69*a* to 69*g* may share a switching element such that the temperatures of certain combinations of heat generation resistor layers can be controlled with a single, shared switching element. In FIG. 3, the electrodes of the respective heat generation resistor layers 69*a* to 69*g* are arranged within the width of the fixing belt 57 in the sheet width direction. In other examples, the electrodes positioned at opposite ends in the sheet width direction may be arranged outside, or partially so, the width of the fixing belt 57.

As illustrated in FIG. 4, a holder 61 that supports heater 59 is supported by a frame 62 on the inner peripheral side of the fixing belt 57. For example, the holder 61 is formed of a thermosetting resin. The holder 61 supports the heater 59 from the lower surface side in FIG. 4. The surface of heater 59 facing the pressing roller 58 will be referred to as heater front surface 59*a*, and opposite surface of the heater 59 will be referred to as a heater back surface 59*b* or, in some contexts, the supported surface of heater 59.

The heater front surface 59*a* is a heating surface on which the heat generation resistor layers 69*a* to 69*g* are arranged below a protective layer (not specifically illustrated). The heater back surface 59*b* is a heat transfer surface to which heat from the heat generation resistor layers 69*a* to 69*g* is transferred through the thickness of the heater 59. When the entire heater back surface 59*b* is in contact with the holder 61, the heat from the heater 59 will be transferred to the holder 61. In this case, the performance of the heater 59 may deteriorate, and the holder 61, which is formed of a resin, is likely to be thermally affected.

The heater 59 is also in contact with and supported by the holder 61 on both the nip upstream side surface and the nip downstream side surface. However, the heater 59 (heater front surface 59*a*) is not in contact with the holder 61 between the nip upstream side and the nip downstream side thus heat transfer to the holder 61 is suppressed.

The holder 61 includes, in this example, a bottom wall portion 71 that is supported by the frame 62; an upstream wall portion 72 that rises from the nip upstream side of the bottom wall portion 71; and a downstream wall portion 73 that rises from the nip downstream side of the bottom wall portion 71. In the cross-sectional view of FIG. 4, the holder 61 is formed roughly in a U-shape in which the bottom wall portion 71, the upstream wall portion 72, and the downstream wall portion 73 are integrated portions. The heater 59 is supported by the holder 61 so fit between the upstream wall portion 72 and the downstream wall portion 73.

The holder 61 includes a first rib 74 (also referred to as a projection or a protrusion) that supports the upstream side of the heater 59 on the nip upstream side, and includes a second rib 75 (also referred to as a projection or protrusion) that supports the downstream side of the heater 59 on the nip downstream side. The first rib 74 and the second rib 75 rise from the bottom wall portion of the holder 61 to the heater 59 so as to be perpendicular to the front and back surfaces of the heater 59. The rising heights of the first rib 74 and the second rib 75 are lower than the rising heights of the upstream wall portion 72 and the downstream wall portion 73. In the embodiment, the first rib 74 is integrated with the upstream wall portion 72 of the holder 61, and the second rib 75 is integrated with the downstream wall portion 73 of the holder 61.

The first rib 74 and the second rib 75 extend along the longitudinal direction (direction corresponding to the sheet width direction) of the heater 59. The first rib 74 and the second rib 75 extend over the full length of the heater 59. The first rib 74 and the second rib 75 are in contact with and support both the nip upstream side and the nip downstream side of the heater back surface 59*b* from below. A side edge 59*c* of the heater 59 in the sheet conveyance direction is near or in contact with the inner wall surface of the upstream wall portion 72 and another side edge 59*c* of the heater 59 in the sheet conveyance direction is near or in contact with the inner wall surface of the downstream wall portion 73. The heater 59 is fixed to the first rib 74, the second rib 75, the upstream wall portion 72, and the downstream wall portion 73 of the holder 61. For example, the heater 59 is bonded to the holder 61 with a silicon-based adhesive.

The holder 61 is separated from the heater back surface 59*b* between the first rib 74 and the second rib 75. A rib or the like that partially supports the heater back surface 59*b* may be provided between the first rib 74 and the second rib 75 of the holder 61. The specific design of holder 61 is not particularly limited so long as some portion is provided that avoids the heater back surface 59*b* between the nip upstream side and the nip downstream side.

The first rib 74 and the second rib 75 come into contact with the heater back surface 59*b* to form a support portion 61*a* that supports the heater 59. The first rib 74 and the second rib 75 are partially notched in the longitudinal direction of the heater 59. That is, a notch portion that is not in contact with the heater back surface 59*b* is partially formed in the first rib 74 and the second rib 75. A retreated (recessed) portion that is not in contact with the heater back surface 59*b* is not limited to a notch portion formed in the rib(s) and may, in other examples, be a hole or other recessed portion that avoids contact with the heater back surface 59*b*. If the retreated portion is only partially formed, the support stiffness of the heater 59 can be improved.

Next, different positions of sheets S accommodated in the sheet accommodation unit 20 will be described.

Figure 5:
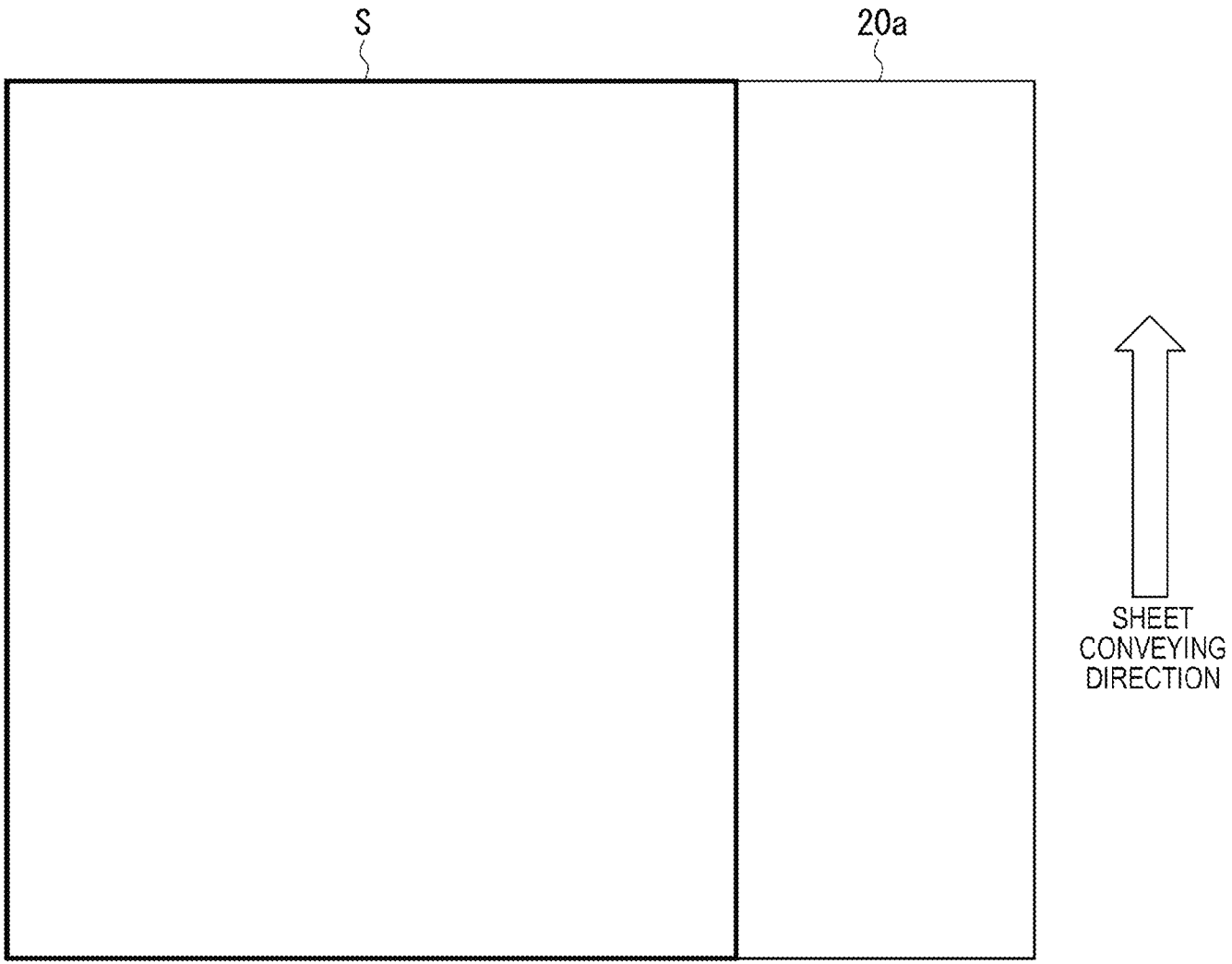
FIGS. 5-7 are diagrams illustrating different positions of sheets accommodated in a sheet accommodation unit.
Figure 6:
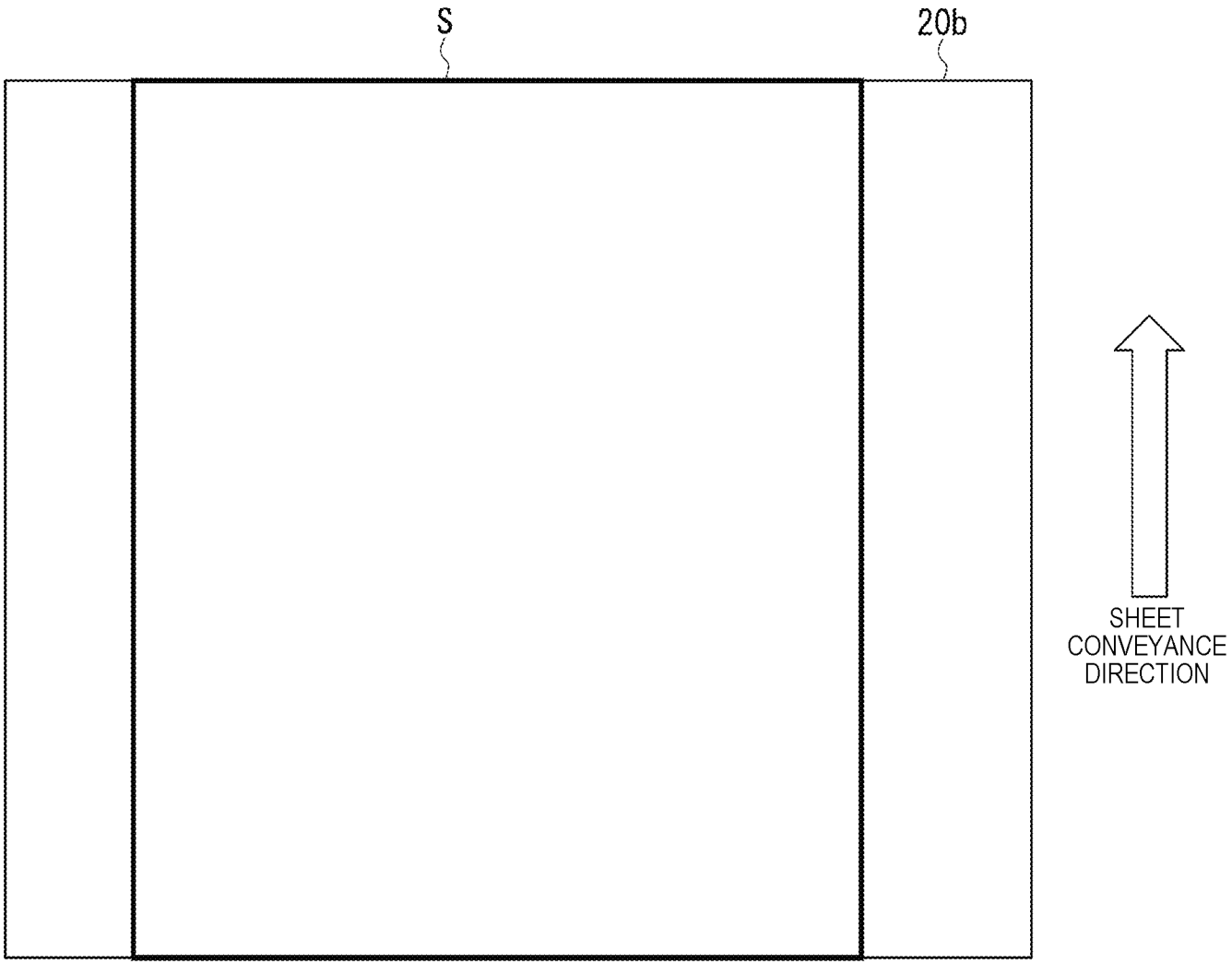
Figure 7:
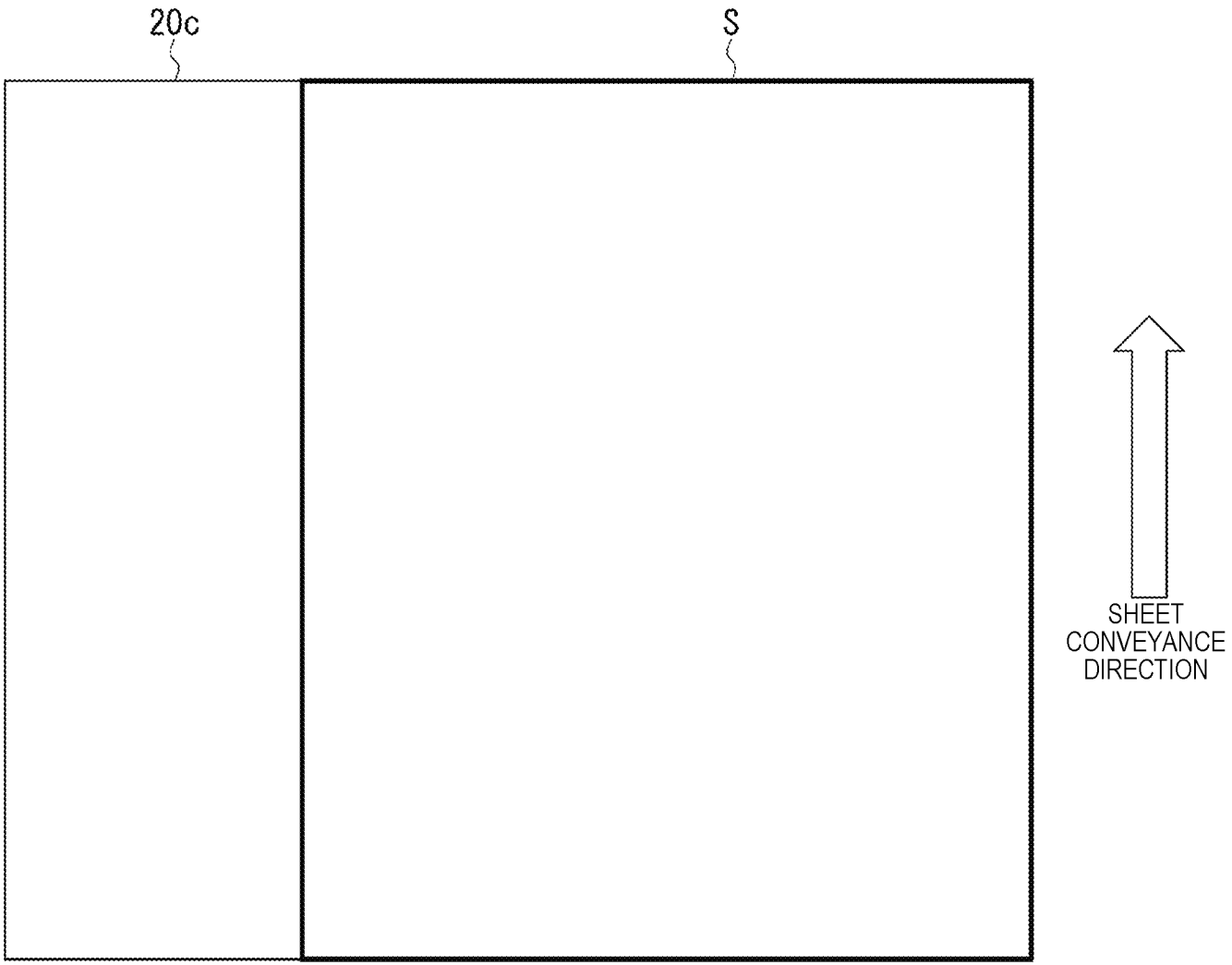

FIGS. 5 to 7 are diagrams illustrating different positions of sheets S accommodated in the sheet accommodation unit 20 according to the embodiment. In the embodiment, for example, the image forming apparatus 100 includes three different sheet accommodation units 20 (sheet accommodation units 20*a* to 20*c*).

FIG. 5 illustrates the position of a sheet S accommodated in the sheet accommodation unit 20*a*. As illustrated in FIG. 5, if the sheet conveyance direction (also referred to as the paper feed direction) is the upper side edge (of the sheet accommodation unit 20, the sheet S is accommodated such that a left edge of the sheet S is positioned along a left inner surface of the sheet accommodation unit 20*a*.

FIG. 6 illustrates the position of a sheet S accommodated in the sheet accommodation unit 20*b*. As illustrated in FIG. 6, when the sheet conveyance direction is set as the upper side edge of the sheet accommodation unit 20*b*, the sheet S is accommodated such that the left side edge from the sheet S is offset from the left inner surface of the sheet accommodation unit 20*b*. As such, the side edges of the sheet S accommodated in the sheet accommodation unit 20*b* are parallel but shifted/offset in left-right position (sheet width direction) from the side edges of the sheet S accommodated in the sheet accommodation unit 20*a*.

FIG. 7 illustrates the position of a sheet S accommodated in the sheet accommodation unit 20*c*. As illustrated in FIG. 7, when the sheet conveyance direction is set as the upper side edge of the sheet accommodation unit 20*c*, the sheet S is accommodated such that a right surface edge of the sheet S is positioned along a right inner surface of the sheet accommodation unit 20*c*.

In this way, sheets S are accommodated to be at positions that are different from each other along a direction perpendicular to the sheet conveyance direction in each of the different sheet accommodation units 20.

Next, a paper-passing position of a sheet S fed from each of the sheet accommodation units 20*a* to 20*c* in the fixing device 30 will be described.

Figure 8:
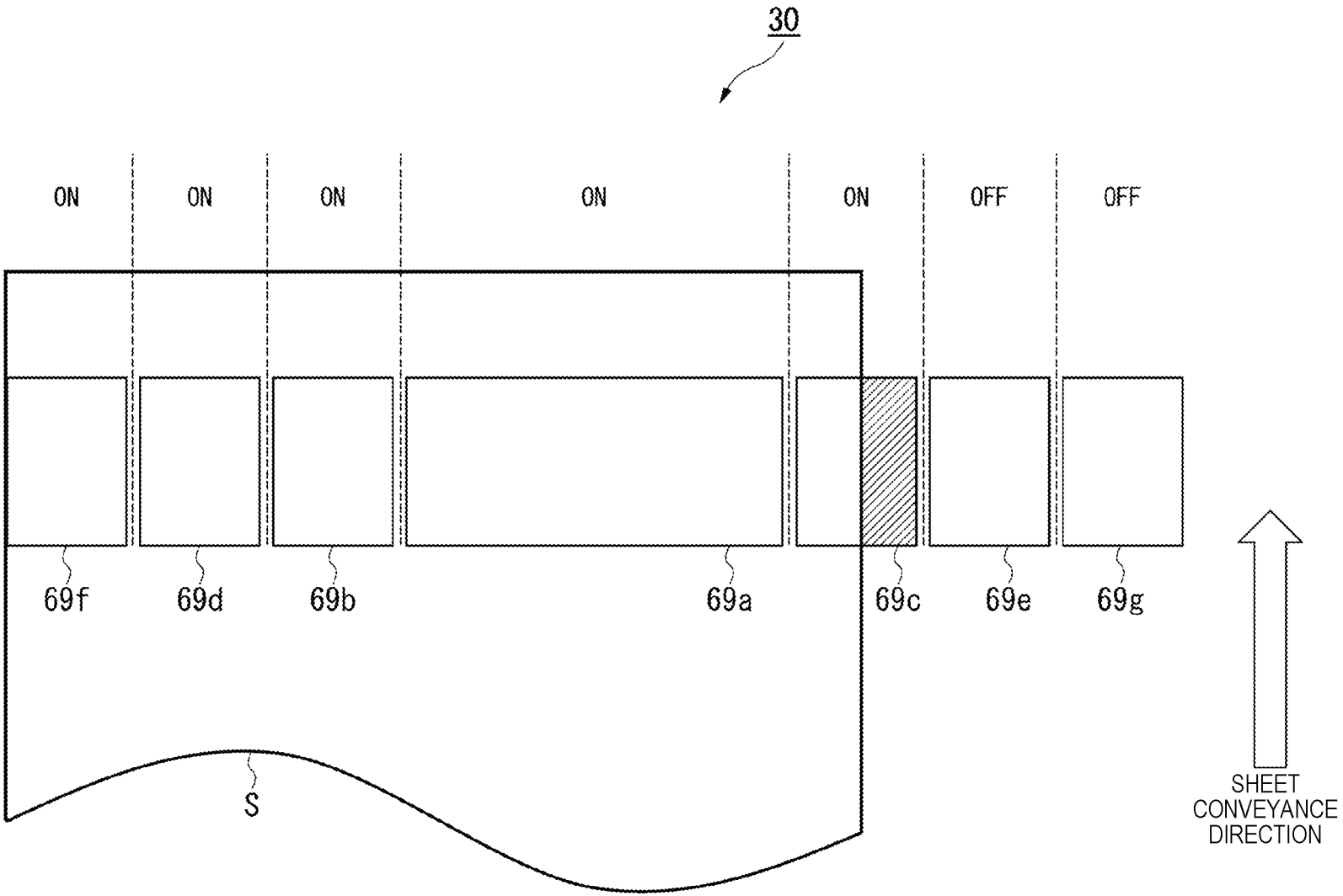
FIGS. 8-10 are diagrams illustrating different paper-passing positions of a sheet in the fixing device.
Figure 9:
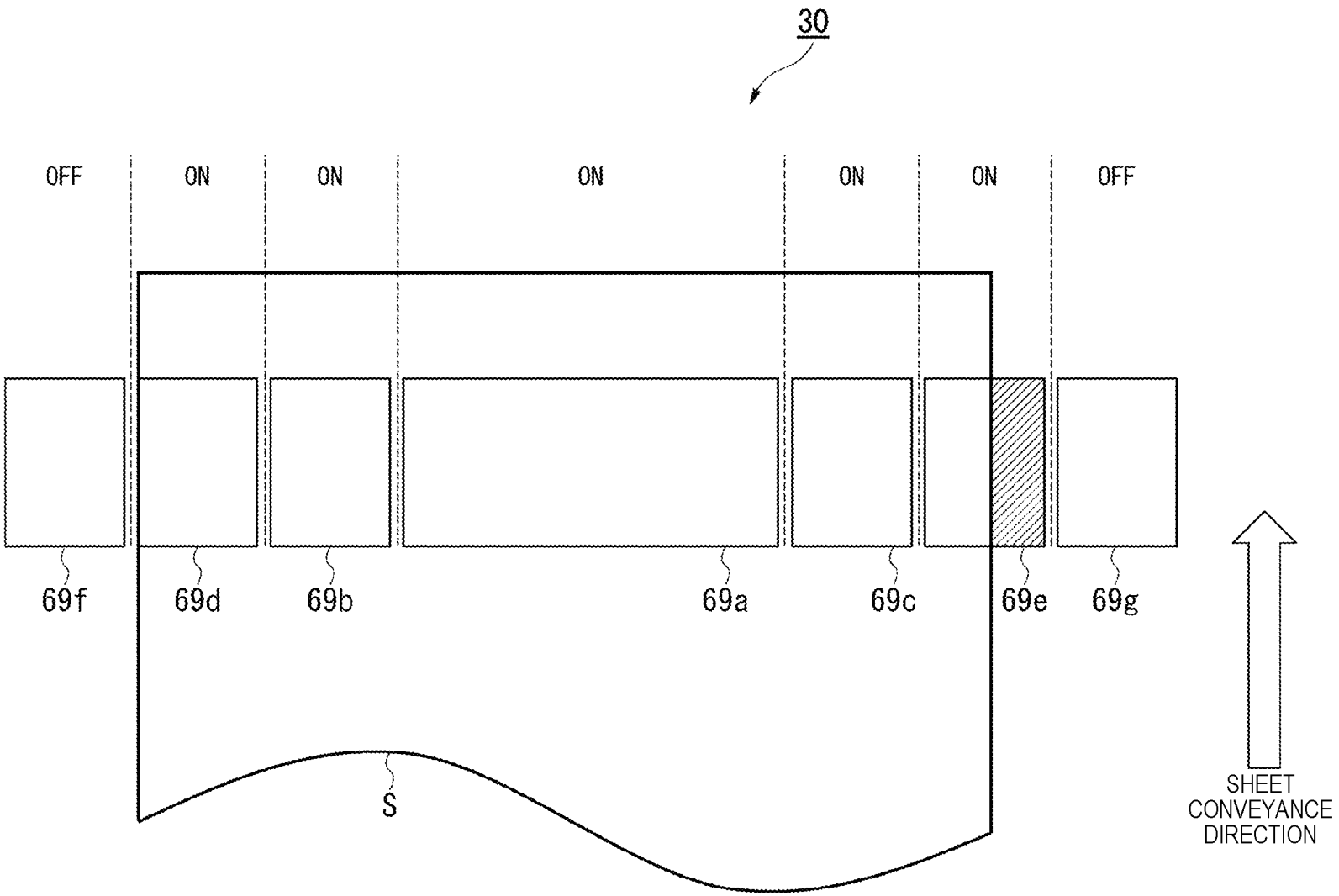
Figure 10:
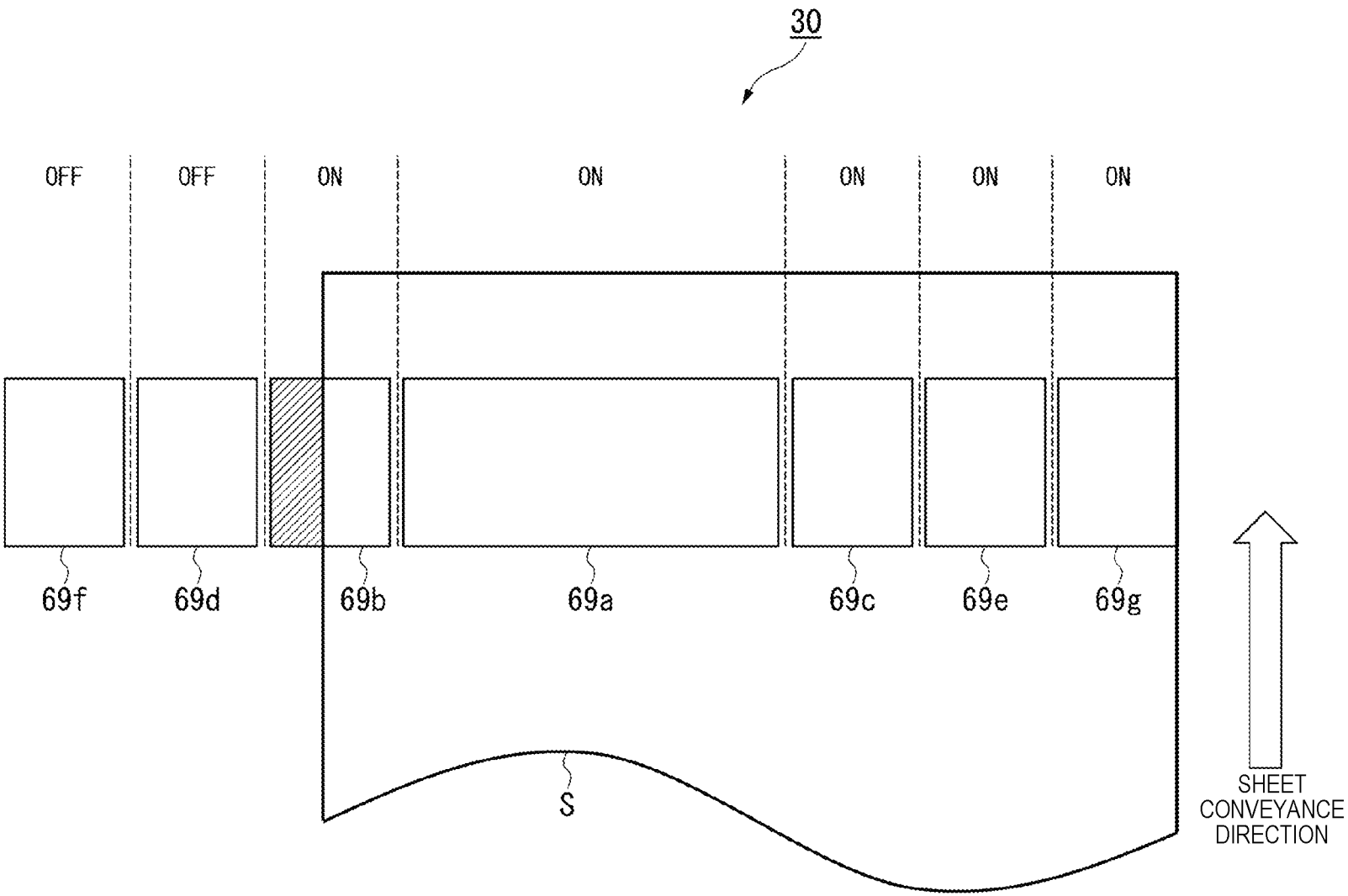

FIGS. 8 to 10 are diagrams illustrating different paper-passing positions of the sheet S through the fixing device 30 according to the embodiment.

FIG. 8 illustrates the paper-passing position of a sheet S fed from the sheet accommodation unit 20*a* through the fixing device 30. As illustrated in FIG. 8, when the sheet conveyance direction is as indicated, the sheet S has a left edge positioned along a lefthand surface side of the heat generation resistor layers 69*a* to 69*g*. More specifically, the left edge of the sheet S passes along the left edge of the heat generation resistor layer 69*f* arranged on the leftmost side.

In this case, as illustrated in FIG. 8, the right edge of the sheet S is positioned on the heat generation resistor layer 69*c*. When the sheet S is fed from the sheet accommodation unit 20*a*, the controller 6 turns on the heat generation resistor layers 69*a* to 69*d* and 69*f* corresponding to this paper-passing position of the sheet S. In addition, when the sheet S is fed from the sheet accommodation unit 20*a*, the controller 6 turns off (does not energize) the heat generation resistor layers 69*e* and 69*g* which correspond to a non-paper passing position. As a result, a reduction in power consumption can be achieved, and deterioration, breakdown, ignition, or the like of a component caused by a temperature increase in the heat generation resistor layers 69*e* and 69*g* (arranged at the non-paper passing position) is suppressed.

However, for example, as illustrated in FIG. 8, the right edge of the sheet S is positioned near the center of the heat generation resistor layer 69*c*, and thus a paper-passing portion and the non-paper passing portion are present together on the heat generation resistor layer 69*c*. Therefore, a range (indicated by oblique lines in FIG. 8) of the heat generation resistor layer 69*c* corresponding to the non-paper passing portion is a range through which the sheet S does not pass even though heat is still being generated in this range of the heat generation resistor layer 69*c*. As a result, the temperature may unwantedly increase in this particular range.

FIG. 9 illustrates the paper-passing position of a sheet S fed from the sheet accommodation unit 20*b* in the fixing device 30. As illustrated in FIG. 9, when the sheet conveyance direction is as indicated, the left edge of the sheet S is positioned along the lefthand edge surface of the heat generation resistor layer 69*d*, which is disposed on the second leftmost side.

In this case, as illustrated in FIG. 9, the right edge of the sheet S is positioned on the heat generation resistor layer 69*e*. When the sheet S is fed from the sheet accommodation unit 20*b*, the controller 6 turns on (energizes) the heat generation resistor layers 69*a* to 69*e* corresponding to the paper-passing position of the sheet S. In addition, when the sheet S is fed from the sheet accommodation unit 20*b*, the controller 6 turns off (does not energize) the heat generation resistor layers 69*f* and 69*g* corresponding to a non-paper passing position. As a result, a reduction in power consumption can be achieved, and deterioration, breakdown, ignition, or the like of a component caused by a temperature increase in the heat generation resistor layers 69*f* and 69*g* arranged at the non-paper passing position is suppressed.

However, as illustrated in FIG. 9, the right edge of the sheet S is positioned near the center of the heat generation resistor layer 69*e*, and thus a paper-passing portion and the non-paper passing portion are present together on the heat generation resistor layer 69*e*. Therefore, a range (indicated by oblique lines in FIG. 9) of the heat generation resistor layer 69*e* corresponding to the non-paper passing position is a range through which the sheet S does not pass although heat is being generated in this range. As a result, the temperature may unwantedly increase in this range.

FIG. 10 illustrates the paper-passing position of a sheet S fed from the sheet accommodation unit 20*c* in the fixing device 30. As illustrated in FIG. 10, when the sheet conveyance direction as indicated, a left edge of the sheet S is positioned along a rightmost edge of the heat generation resistor layers 69*a* to 69*g*. More specifically, the right edge of the sheet S passes along the righthand edge side of the heat generation resistor layer 69*g* arranged on the rightmost side.

In this case, as illustrated in FIG. 10, the left edge of the sheet S is positioned on the heat generation resistor layer 69*b*. When the sheet S is fed from the sheet accommodation unit 20*c*, the controller 6 turns on (energizes) the heat generation resistor layers 69*a* to 69*c*, 69*e*, and 69*g* corresponding to the paper-passing position for the sheet S. In addition, when the sheet S is fed from the sheet accommodation unit 20*c*, the controller 6 turns off (does not energize) the heat generation resistor layers 69*d* and 69*f* corresponding to a non-paper passing position. As a result, a reduction in power consumption can be achieved, and deterioration, breakdown, ignition, or the like of a component caused by a temperature increase in the heat generation resistor layers 69*d* and 69*f* corresponding to the non-paper passing position is suppressed.

However, as illustrated in FIG. 10, the left edge of the sheet S is positioned near the center of the heat generation resistor layer 69*b*, and thus a paper-passing portion and a non-paper passing portion are present together on the heat generation resistor layer 69*b*. Therefore, a range (indicated by oblique lines in FIG. 10) of the heat generation resistor layer 69*b* corresponding to the non-paper passing position is a range through which the sheet S does not pass even though heat is being generated in this range. As a result, the temperature may unwantedly increase in this range.

When temperature information regarding an unwanted temperature increase in a particular heat generation resistor layer is acquired, the controller 6 of the image forming apparatus 100 according to the embodiment feeds the sheet S from the sheet accommodation unit 20 such that the entire position of the particular heat generation resistor layer indicated by the temperature information becomes a paper-passing position for the sheet S.

As a method in which the controller 6 acquires the temperature information regarding the unwanted temperature increase in a particular heat generation resistor layer, any suitable method may be adopted. For example, the controller 6 may generate the temperature information for specific heat generation resistor layers based on an operation history of the fixing unit, such as the paper-passing position of the sheet S that has been most recently fed or fixed. Specifically, for example, when a predetermined number of sheets S have been continuously fed from the sheet accommodation unit 20*a*, the controller 6 may estimate that the temperature of the heat generation resistor layer 69*c* (that is, the heat generation resistor layer including an oblique line portion illustrated in FIG. 8) unwantedly increases.

In other examples, or in combination with the above example, the image forming apparatus 100 may include a detection unit (e.g., thermistor, thermocouple, etc.) that can detect a temperature increase in each of the heat generation resistor layers 69*a* to 69*g*. In this case, the controller 6 can detect the temperature increase(s) in specific heat generation resistor layers based on the detection result from the detection unit. Specifically, the fixing device 30 may include a member (for example, a thermistor) that can measure the temperatures of each of the heat generation resistor layers 69*a* to 69*g*. In this case, the controller 6 may generate the temperature information regarding the temperature increase in a specific heat generation resistor layer, for example, based on the fact that the measured temperature is higher than or equal to a predetermined temperature.

As a method of determining or selecting the sheet accommodation unit 20 that should feed the next sheet S when the controller 6 acquires the temperature information regarding a temperature increase in a specific heat generation resistor layer, in general, any method may be adopted. For example, the controller 6 may select a sheet accommodation unit 20 to feed the sheet S by referring to correspondence information stored in the auxiliary storage device 93. The correspondence information refers, in this context, to information by which each of the heat generation resistor layers 69*a* to 69*f* is associated with a sheet accommodation unit 20 to be used when temperature information indicates a temperature increase the particular heat generation resistor layers 69*a* to 69*f*.

The controller 6 also converts or adjust the image data based on the sheet accommodation unit 20 that is being used to feed the sheet S the image formed on the sheet is appropriately formed at a position corresponding to the paper-passing position of the sheet S as be fed.

Figure 11:
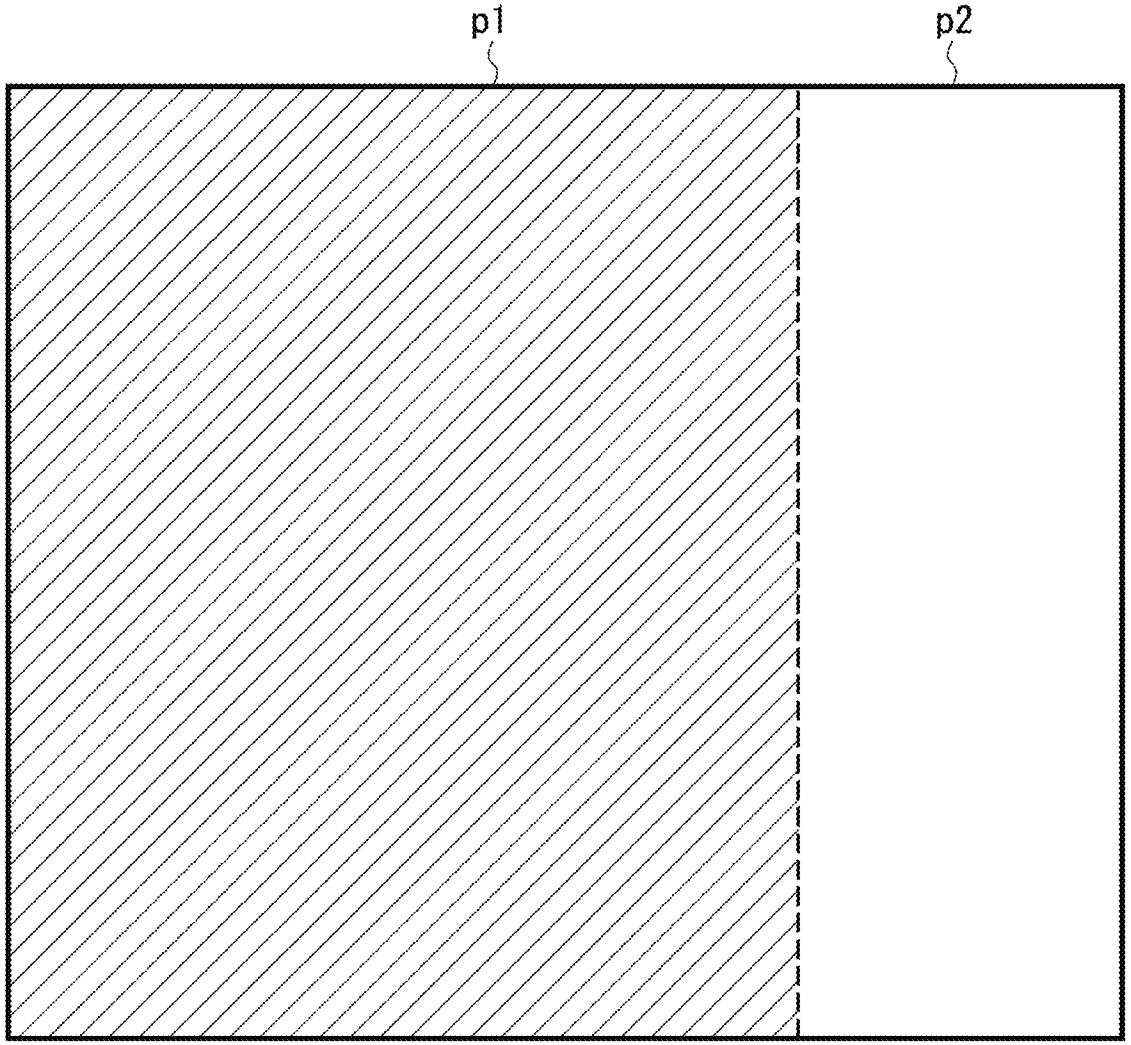
FIGS. 11-13 are diagrams illustrating different image conversions performed by a controller.
Figure 12:
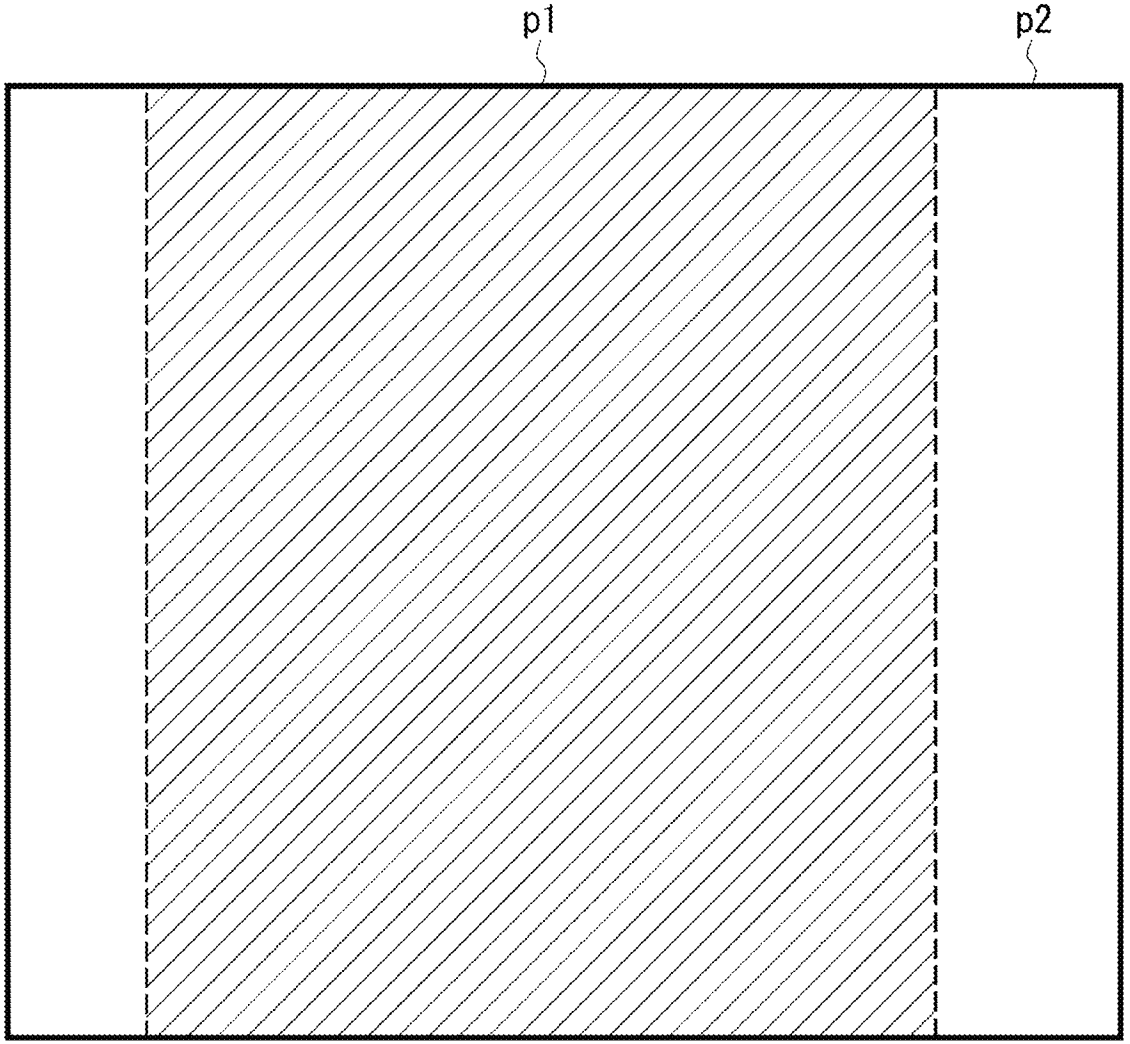
Figure 13:
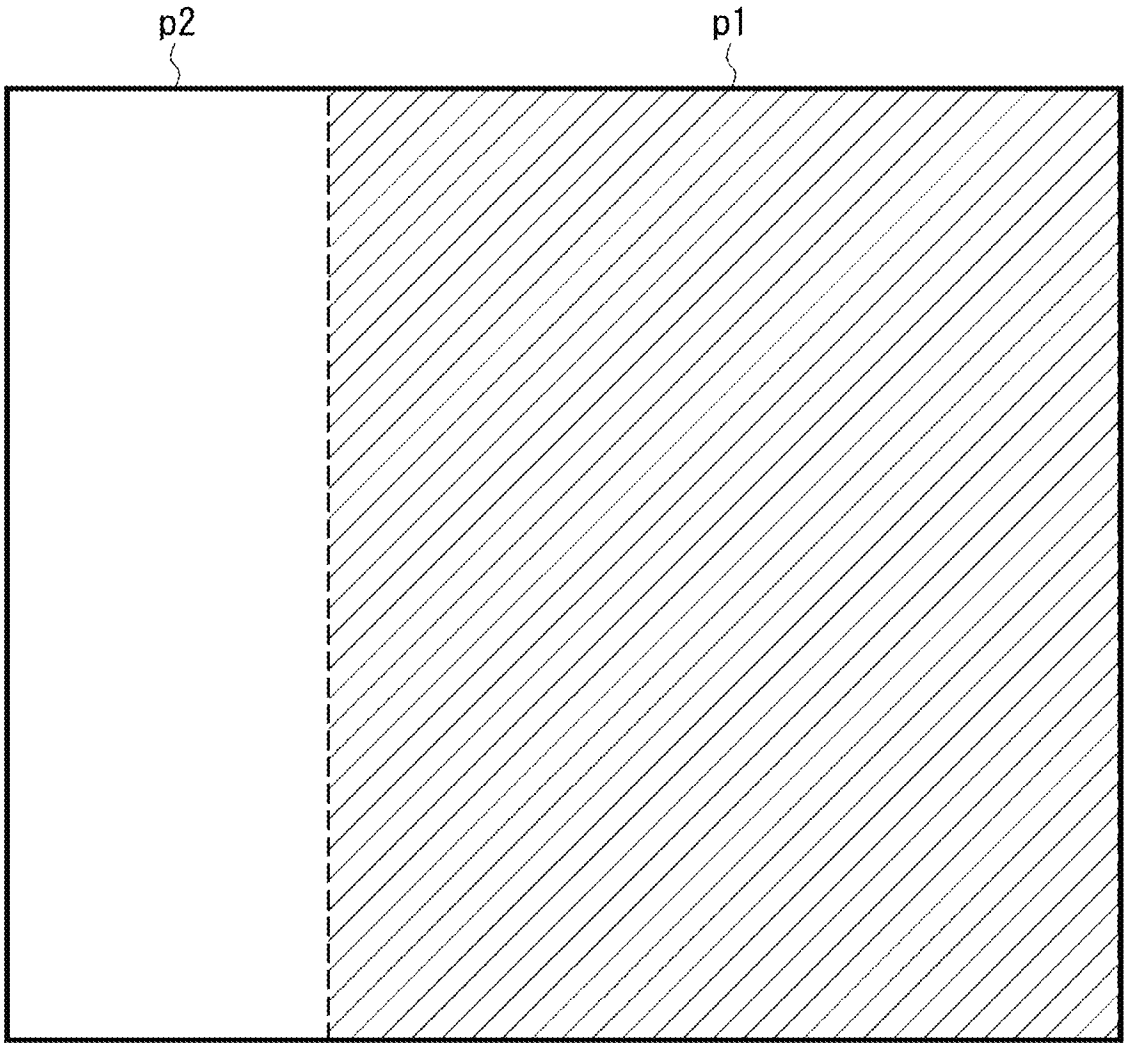

FIGS. 11 to 13 are diagrams illustrating different image conversions performed by the controller 6 according to the embodiment.

FIG. 11 illustrates image conversion that is executed by the controller 6 when it is determined that the sheet S is being fed from the sheet accommodation unit 20*a*. In FIG. 11, an image p1 (oblique lined portion) is an image (first image) representing image data to be printed before the conversion into modified image data corresponding to the particular position of the sheet S as fed. The controller 6 converts the image p1 into an image p2 (second image) by adding a margin on the right side of the image p1. As can be seen from a comparison between FIG. 5 and FIG. 11, a position of a region corresponding to the image p1 in the image p2 and a position where the sheet S is accommodated in the sheet accommodation unit 20*a* are associated with each other so as to match.

FIG. 12 illustrates image conversion that is executed by the controller 6 when it is determined that the sheet S is being fed from the sheet accommodation unit 20*b*. Similarly to as described above, in FIG. 12, an image p1 (oblique lined portion) is an image represented by image data to be printed before being converted into modified image data corresponding to the actual position of the sheet S as fed. The controller 6 converts the image p1 into an image p2 by adding a margin to the right and left sides of the image p1. As can be seen from a comparison between FIG. 6 and FIG. 12, a position of a region corresponding to the image p1 in the image p2 and a position where the sheet S is accommodated in the sheet accommodation unit 20*b* are associated with each other so as to match.

FIG. 13 illustrates image conversion that is executed by the controller 6 when it is determined that the sheet S is being fed from the sheet accommodation unit 20*c*. Similarly as described above, in FIG. 13, an image p1 (oblique lined portion) is an image represented by image data before being converted into modified image data corresponding to an image as a target image to be formed. The controller 6 converts the image p1 into an image p2 by adding a margin to the left side of the image p1. As can be seen from a comparison between FIG. 7 and FIG. 13, a position of a region corresponding to the image p1 in the image p2 and a position where the sheet S is accommodated in the sheet accommodation unit 20*c* are associated with each other so as to match.

The controller 6 adds a margin to the periphery of the image p1, for example, such that the image p2 has a maximum width for which the image p1 is fixable by the fixing device 30 or a maximum width of an image formable by an image forming unit, such as the image forming unit 3 described above.

Next, operations of the image forming apparatus 100 will be described. The operations of the image forming apparatus 100 described below are exemplary, and the present disclosure is not limited thereto as various operational modifications are possible.

Figure 14:
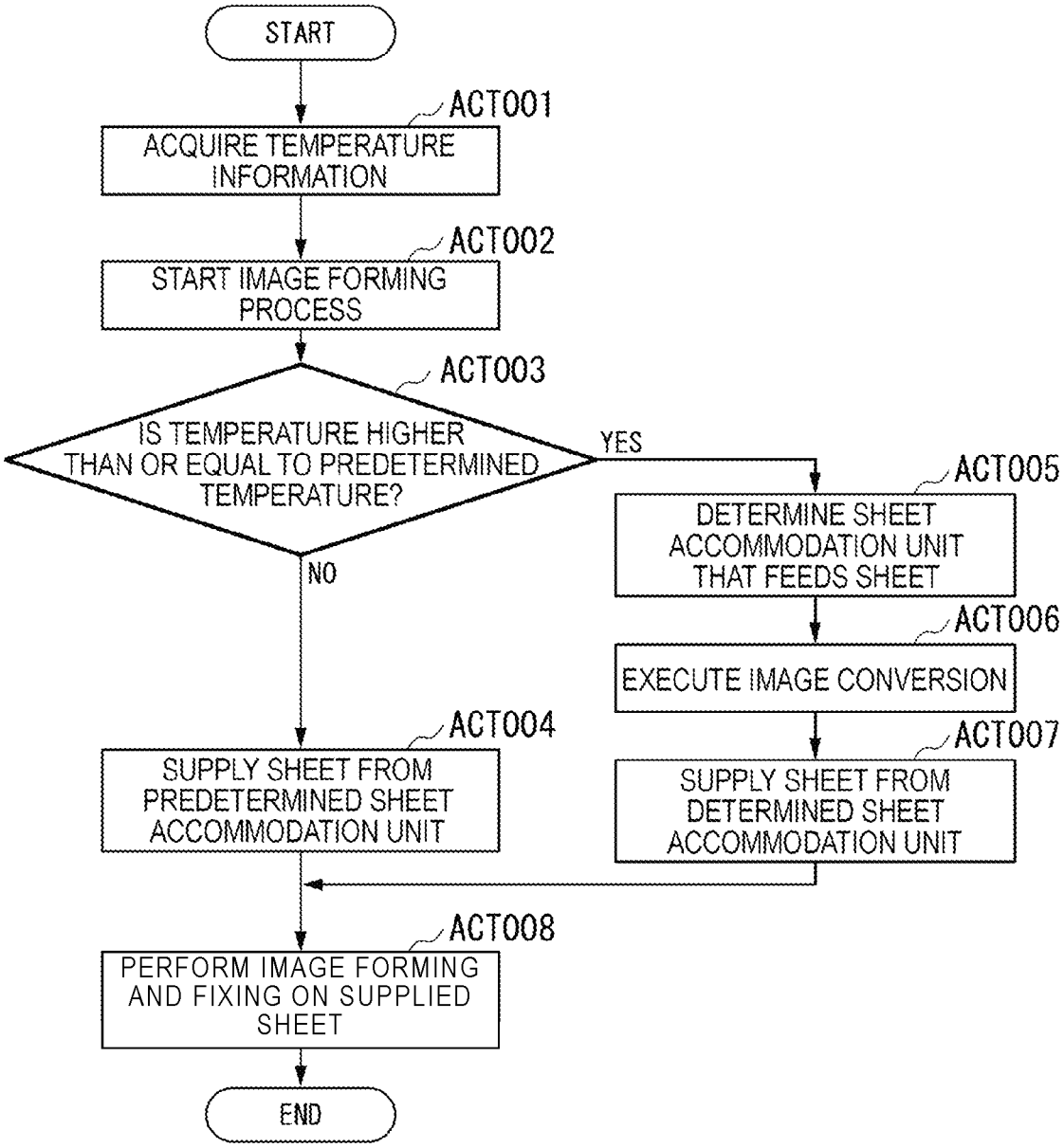
FIG. 14 is a flowchart illustrating operations.

FIG. 14 is a flowchart illustrating operations of the image forming apparatus 100 according to an embodiment. This flowchart starts when temperature information is generated.

The controller 6 acquires the temperature information (ACT 001). Next, the controller 6 causes functional units of the image forming apparatus 100 to start an image forming process (ACT 002).

When the temperature indicated by the temperature information is lower than a predetermined temperature (NO in ACT 003), the controller 6 feeds the sheet S from a predetermined one of the sheet accommodation units (for example, the sheet accommodation unit 20*a*) (ACT 004).

When the temperature indicated by the temperature information is higher than or equal to a predetermined temperature (YES in ACT 003), the controller 6 changes the sheet accommodation unit 20 used to feed the sheet S based on the position of the particular heat generation resistor that has been indicated by the temperature information as too high (ACT 005).

The controller 6 executes image conversion on image data such that a margin is added to a periphery of an image as a target image to be formed based on the determination of the sheet accommodation unit 20 that feeds the sheet S (ACT 006). For example, when the controller 6 determines that a sheet is to be fed from the sheet accommodation unit 20*a* (FIG. 5), the controller 6 performs conversion of image data as illustrated (FIG. 11). For example, when the controller 6 determines that a sheet is to be fed from the sheet accommodation unit 20*b* (FIG. 6), the controller 6 performs conversion of image data as illustrated in FIG. 12. For example, when the controller 6 determines that a sheet is to be fed from the sheet accommodation unit 20*c* (FIG. 7), the controller 6 performs conversion of image data as illustrated in FIG. 13.

The controller 6 feeds the sheet S from the selected sheet accommodation unit 20 (ACT 007).

The controller 6 control the image forming unit to perform image formation based on image data or modified image data on the fed sheet S, and the fixing device 30 fixes the toner image formed on the fed sheet S (ACT 008). For example, when the controller 6 determines that a sheet is to be fed from the sheet accommodation unit 20*a*, the controller 6 causes the sheet to pass through a position as illustrated in FIG. 8. For example, when the controller 6 determines that a sheet is to be fed from the sheet accommodation unit 20*b*, the controller 6 causes the sheet to pass through a position as illustrated in FIG. 9. For example, when the controller 6 determines that a sheet is to be fed from the sheet accommodation unit 20*c*, the controller 6 causes the sheet to pass through a position as illustrated in FIG. 10.

The operations of the image forming apparatus 100 illustrated in the flowchart of FIG. 14 end after the fixing of an image to the sheet S, but the image forming apparatus 100 may perform additional steps or operations on the sheet S before final discharge of the sheet S.

As described above, the image forming apparatus 100 according to the embodiment includes the fixing device 30 and the controller 6. The controller 6 acquires image data for the image p1 (first image) as a target image to be formed. The controller 6 then converts the image p1 as necessary to an image p2 (second image) for which a margin is (or margins are) added to a periphery of the image p1. The controller 6 causes a sheet accommodation unit 20 to feed the sheet S at a position where the image p1 in the image p2 will be appropriately fixed by the fixing device 30.

With the above-described configuration, in the image forming apparatus 100 according to an embodiment, when the temperature of a specific heat generation resistor unwantedly or unnecessarily increases, a desired image can still be formed while causing a sheet S to pass through the position of the specific heat generation resistor experiencing the temperature increase. In this way, by causing a sheet S to pass through a position corresponding to specific heat generation resistor, heat from the specific heat generation resistor will be absorbed by the passing sheet S. As a result, in the image forming apparatus 100 according to the embodiment, the temperature increase in the heat generation resistor layers 69*a* to 69*f* (heaters) can be suppressed or mitigated.

In the image forming apparatus 100 according to an embodiment, when the paper-passing position is changed, for example, it is not necessary to align the position of the sheet S to be fed and a print position of an image as a target image to be formed relative to each other. As a result, the image forming apparatus 100 according to the embodiment can execute the image forming process with high speed.

In the above description, the image forming apparatus 100 includes three sheet accommodation units 20*a* to 20*c* as an example, and the sheets S are accommodated at different positions from each other in the direction perpendicular to the paper feed direction in each respective sheet accommodation units 20. However, the present disclosure is not limited to this configuration. For example, a single sheet accommodation unit 20 may include a guide member connected to a drive source, and the guide member can be movable in a direction perpendicular to the paper feed direction to vary a paper feeding position of each sheet S fed from the sheet accommodation unit 20.

Some portions of the image forming apparatus 100 may be implemented by a computer. In this case, the described function(s) may be performed by executing a program (e.g., software) on a processor of the computer. Such a program may be stored in a non-transitory computer-readable medium provided to the computer or otherwise provided over a network connection or the like.

"Computer system" as described herein may refer to a computer system built into the image forming apparatus 100 and includes software, such as an operating system (OS), and hardware including peripheral devices and the like. In this context, "computer-readable recording medium" refers to a storage medium such as a flexible disk, an magneto-optic disk, a flash memory, an electric erasable programmable read-only memory (EEPROM), a read only memory (ROM), a random access read/write memory (RAM), a compact disc-read only memory (CD-ROM), a storage device such as a hard disk drive, and/or a solid-state drive. Such a storage medium may be built into a computer system or portable and/or separately provided from the computer system.

Furthermore, a "computer-readable recording medium" may be a server or other networked terminal and may be accessed, or otherwise provided, via a network connection or the like, such as the Internet or a telephone line. Such a computer-readable medium may be a portion of a distributed and/or "cloud-based" system and the computer system implementing the program may similarly be a distributed or cloud-based system. The program may serve alone to implement some or all of the above-described functions or some or all of the above-described functions may implemented in combination with a program (or programs) recorded in the computer system in advance.

In some examples, aspects of image forming apparatus 100 according to the embodiment may be implemented by an integrated circuit such as a large scale integration (LSI) or the like. The respective functional blocks of the image forming apparatus 100 may be individually configured with dedicated processors and/or hardware circuits, or some or all of the functional blocks may be integrated into a single processor. The method for circuit integration is not limited to LSI, and an integrated circuit may be implemented by a variety of dedicated circuits and/or a general-purpose processor. In general, any circuit integration technique, whether a LSI technique or otherwise, may be adopted in this context.

While certain embodiments have been described these embodiments have been presented by way of example only, and are not intended to limit the scope of the inventions. Indeed, the novel embodiments described herein may be embodied in a variety of other forms; furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus, comprising:

an image forming unit configured to form an image and transfer the image to a sheet;

a fixing unit configured to fix the image on the sheet, the fixing unit including a plurality of heater elements arranged in the sheet width direction; and a controller configured to:

receive image data corresponding to a target image to be formed on the sheet;

acquire temperature information of the plurality of heater elements, the temperature information indicating one of the heater elements above a predetermined temperature;

convert the received image data to modified image data corresponding to a modified image that includes the target image and a margin on at least one side of the target image in the sheet width direction in accordance with a position of the one of the heater elements in the sheet width direction, a margin size of the modified image being different from a margin size of the target image;

control the image forming unit to form the modified image;

cause the sheet to be conveyed to the image forming unit such that the target image included in the modified image overlaps with and is transferred to the sheet and then to the fixing unit such that the one of the heater elements overlaps with the sheet.

2. The image forming apparatus according to claim 1, wherein a width of the modified image in the sheet width direction is greater than a width of the sheet in the sheet width direction.

3. The image forming apparatus according to claim 1, wherein a width of the modified image in the sheet width direction is a maximum width of images that are formable by the image forming unit.

4. The image forming apparatus according to claim 1, further comprising:

a plurality of sheet storages configured to feed sheets at different positions along the sheet width direction, wherein the controller is configured to cause the sheet to be fed from one of the plurality of sheet storages such that the target image included in the modified image overlaps with the sheet.

5. The image forming apparatus according to claim 1, wherein the controller acquires the temperature information as an operation history of the fixing unit.

6. The image forming apparatus according to claim 1, wherein the modified image includes a margin on each side of the target image in the sheet width direction.

7. The image forming apparatus according to claim 1, further comprising:

a first sheet storage configured to feed sheets at a first position in the sheet width direction; and a second sheet storage configured to feed sheets at a second position in the sheet width direction.

8. The image forming apparatus according to claim 1, wherein each of the heater elements is independently controllable to be on or off when fixing the image to the sheet.

9. The image forming apparatus according to claim 1, wherein the controller acquires the temperature information from a temperature sensor.

10. The image forming apparatus according to claim 1, wherein the controller is configured to:

convert the received image data to first modified image data corresponding to a first modified image that includes the target image and a margin on a first side of the target image in the sheet width direction, when the one of the heater elements is closer to a first end of the fixing unit than to a second end of the fixing unit opposite to the first end, and convert the received image data to second modified image data corresponding to a second modified image that includes the target image and a margin on a second side of the target image opposite to the first side in the sheet width direction, when the one of the heater elements is closer to the second end of the fixing unit than to the first end of the fixing unit, the first and second sides of the target image corresponding to the second and first ends of the fixing unit, respectively.

11. The image forming apparatus according to claim 10, wherein the controller is configured to:

cause the conveyed sheet to be shifted toward the first end of the fixing unit in the sheet width direction, when the one of the heater elements is closer to the first end of the fixing unit than to the second end of the fixing unit, and cause the conveyed sheet to be shifted toward the second end of the fixing unit in the sheet width direction, when the one of the heater elements is closer to the second end of the fixing unit than to the first end of the fixing unit.

12. The image forming apparatus according to claim 1, wherein the predetermined temperature is higher than a fixing temperature to fix an image on a sheet.

13. An image forming method, comprising:

receiving image data corresponding to a target image to be formed by an image forming unit;

acquiring temperature information of a plurality of heater elements included in a fixing unit, the temperature information indicating one of the heater elements above a predetermined temperature;

converting the received image data to modified image data corresponding to a modified image that includes the target image and a margin on at least one side of the target image in the sheet width direction in accordance with a position of the one of the heater elements in the sheet width direction, a margin size of the modified image being different from a margin size of the target image;

controlling the image forming unit to form the modified image; and causing the sheet to conveyed to the image forming unit such that the target image included in the modified image overlaps with and is transferred to the sheet and then to the fixing unit such that the one of the heater elements overlaps with the sheet.

14. The image forming method according to claim 13, wherein a width of the modified image in the sheet width direction is greater than a width of the sheet in the sheet width direction.

15. The image forming method according to claim 13, wherein a width of the modified image in the sheet width direction is a maximum width of images that are formable by the image forming unit.

16. The image forming method according to claim 13, wherein the image forming apparatus includes a plurality of sheet storages configured to feed sheets at different positions along the sheet width direction, respectively.

17. The image forming method according to claim 13, wherein said converting the received image data to modified image data comprises:

converting the received image data to first modified image data corresponding to a first modified image that includes the target image and a margin on a first side of the target image in the sheet width direction, when the one of the heater elements is closer to a first end of the fixing unit than to a second end of the fixing unit opposite to the first end; and converting the received image data to second modified image data corresponding to a second modified image that includes the target image and a margin on a second side of the target image opposite to the first side in the sheet width direction, when the one of the heater elements is closer to the second end of the fixing unit than to the first end of the fixing unit, the first and second sides of the target image corresponding to the second and first ends of the fixing unit, respectively.

18. The image forming method according to claim 17, wherein said causing the sheet to conveyed to the fixing unit comprises:

causing the conveyed sheet to be shifted toward the first end of the fixing unit in the sheet width direction, when the one of the heater elements is closer to the first end of the fixing unit than to the second end of the fixing unit; and causing the conveyed sheet to be shifted toward the second end of the fixing unit in the sheet width direction, when the one of the heater elements is closer to the second end of the fixing unit than to the first end of the fixing unit.

19. The image forming method according to claim 13, wherein the predetermined temperature is higher than a fixing temperature to fix an image on a sheet.

* * * * *